US006930294B2

(12) United States Patent
Kim

(10) Patent No.: US 6,930,294 B2
(45) Date of Patent: Aug. 16, 2005

(54) MICROWAVE OVEN AND METHOD OF CONTROLLING THE SAME

(75) Inventor: Kwang-Keun Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 71 days.

(21) Appl. No.: 10/412,217

(22) Filed: Apr. 14, 2003

(65) Prior Publication Data

US 2004/0104219 A1 Jun. 3, 2004

(30) Foreign Application Priority Data

Dec. 2, 2002 (KR) ..... 10-2002-0076075

(51) Int. Cl.[7] ..... H05B 6/68

(52) U.S. Cl. ..... 219/685; 219/702; 219/404; 99/325

(58) Field of Search ..... 219/681–685, 219/702, 716, 402–404; 99/325

(56) References Cited

U.S. PATENT DOCUMENTS 4,596,914 A 6/1986 Morino
4,629,850 A * 12/1986 Tanabe ..... 219/685
4,798,927 A * 1/1989 Kaminaka ..... 219/685
5,360,965 A * 11/1994 Ishii et al. ..... 219/705
5,693,246 A 12/1997 Han et al.
5,793,023 A 8/1998 Hong et al.
5,811,768 A * 9/1998 Choi et al. ..... 219/704
6,686,568 B1 * 2/2004 Hwang ..... 219/404

FOREIGN PATENT DOCUMENTS

DE 100 45 458 A1 3/2002
EP 682 462 A3 11/1995
EP 682 462 A2 11/1995

* cited by examiner

*Primary Examiner*—Philip H. Leung
(74) *Attorney, Agent, or Firm*—Staas & Halsey LLP

(57) ABSTRACT

A microwave oven and a method of controlling the same that is capable of detecting the respective positions of heaters using detectors for which a number thereof is less than a number of cooking modes. Cooking is performed with the heaters in respective horizontal positions in a cooking mode in which cooking requiring the heaters to heat food is performed, while cooking is performed with the heaters positioned in the respective initial positions in a cooking mode in which the cooking not requiring the heaters to heat the food is performed. Each of the detectors is a micro switch operated by a cam. Accordingly, in the microwave oven and in the method of controlling the same, the number of the detectors to detect the respective positions of the heaters is decreased. Further, an electrical wire is connected to a single micro switch to detect the respective positions of the heaters.

33 Claims, 7 Drawing Sheets

FIG. 3

| | 0° (UPWARDLY UPRIGHT) | 90° (UPPER HORIZONTAL) | 180° (DOWNWARDLY UPRIGHT) | 270° (LOWER HORIZONTAL) |
|---|---|---|---|---|
| MIDDLE HEATER | | | | |
| CAM | | | | |
| MICRO SWITCH | ON | ON | OFF | OFF |

MICROWAVE OVEN AND METHOD OF CONTROLLING THE SAME

CROSS-REFERENCE TO RELATED APPLICATION

This application claims the benefit of Korean Application No. 2002-76075, filed Dec. 2, 2002, in the Korean Intellectual Property Office, the disclosure of which is incorporated herein by reference.

BACKGROUND OF THE INVENTION

1. Field of the Invention

The present invention relates to a microwave oven and method of controlling the same that is capable of performing cooking using electrical heaters.

2. Description of the Related Art

Microwave ovens are generally provided with magnetrons that generate microwaves and cook food by heating the food using the microwaves.

When cooking is performed using only microwaves generated from the magnetron, the microwaves may not uniformly radiate the food according to a water content, a distribution and a size of the food, so the food may not be satisfactorily cooked. Further, various kinds of cooking may not be performed. For this reason, electrical heaters (hereinafter simply referred to as "heaters") are installed in the cooking cavity of the microwave oven, so heat generated from the heaters is transferred to the food while the microwaves generated from the magnetron also radiate the food. Accordingly, the food is quickly and uniformly cooked.

The heaters installed in the microwave oven are fixedly positioned in respective predetermined portions of a cooking cavity, but the respective predetermined positions of the heaters may not be changed according to a volume and the size of the food. Accordingly, the heaters need to be rotatably installed to more satisfactorily cook the food. Further, the heaters need to be rotatably installed to allow the food to be easily put into or taken out of the cooking cavity.

A microwave oven has been developed in which the heaters are, respectively, horizontally positioned in a cooking mode wherein cooking by heating of the heaters is performed, while the respective positions of heaters may be changed using a motor so that the heaters are, respectively, positioned in predetermined portions of the cooking cavity in cooking modes when the heaters are not used. In the microwave oven, respective positions of the heaters are detected using two micro switches so as to detect the respective positions where the heaters are used, for example, respective horizontal positions where the heaters are horizontally positioned, and positions where the heaters are not used, for example, respective vertical positions where the heaters are vertically positioned.

As described above, the microwave oven is provided with the micro switches of a number equal to a number of cooking modes of the microwave oven. As more heaters are installed in the microwave oven, more micro switches should be provided to detect the respective positions of the heaters, so the microwave oven is disadvantageous in that a manufacturing cost thereof is increased.

Further, when the microwave oven is provided with a plurality of micro switches, detection signals of the plurality of micro switches are transferred through corresponding electrical wires to corresponding input terminals of a microcomputer. In this case, the electrical wires may be incorrectly connected to the plurality of micro switches in an assembly process. For example, in a case where a plurality of electrical wires are connected to the plurality of micro switches that detect the respective vertical and horizontal positions of the heaters, the respective vertical and horizontal positions of the heaters are incorrectly detected in the microcomputer if the plurality of electrical wires are incorrectly connected to the corresponding micro switches due to manufacturing errors by a producer. Thus, cooking is performed with the heaters inappropriately positioned in the cooking cavity, so the cooking may not be adequately performed.

SUMMARY OF THE INVENTION

Accordingly, it is an aspect of the present invention to provide a microwave oven and a method of controlling the same, which is capable of detecting respective positions of heaters using detectors, a number thereof being less than a number of cooking modes.

Another aspect is to provide a microwave oven and a method of controlling the same, in which a number of the detectors to detect respective positions of the heaters is decreased, thereby reducing a manufacturing cost of the microwave oven.

A further aspect is to provide a microwave oven and a method of controlling the same, which prevents an inadequate cooking resulting from incorrect connections of electrical wires to detectors that detect respective positions of heaters.

Additional aspects and/or advantages of the invention will be set forth in part in the description which follows and, in part, will be obvious from the description, or may be learned by practice of the invention.

The above and/or other aspects of the present invention are achieved by providing a microwave oven including one or more electrical heaters rotatably disposed in a cooking cavity, a heater drive unit that rotates the electrical heaters, and a heater position detection unit that detects respective rotation positions of two or more electrical heaters using one or more detectors, a number of the detectors is less than a number of cooking modes.

Accordingly, each of the detectors may be a micro switch.

Further, the respective rotation positions of the electrical heaters may be changed according to the cooking modes.

Further, the heater position detection unit may include a control unit that determines whether the respective rotation positions of the electrical heaters are respective initial positions.

Further, the control unit may check the respective rotation positions of the electrical heaters in a case where power is initially supplied or the power is re-supplied after supply of the power is cut off.

Further, the respective initial positions may be positions where the electrical heaters are vertically positioned next to left and right sidewalls, respectively, of the cooking cavity.

Further, the heater position detection unit may include a cam that operates the detectors according to the respective rotation positions of the electrical heaters.

Further, the cam may be shaped in a form of two semicircles having different radii and may be joined at a straight edge thereof such that an arc of a semicircle with a large radius may come into contact with the detectors to turn-on the detectors, while an arc of a semicircle with a small radius may not come into contact with the detectors and may not turn on the detectors.

Further, the heater drive unit may include a motor that rotates the electrical heaters, and a gear that is attached to a drive shaft of the motor and rotated together with the drive shaft.

Further, the cooking modes may be divided into a first cooking mode where the food is cooked using a magnetron but not the electrical heaters, and a second cooking mode where the food is cooked using both the magnetron and the electrical heaters.

Further, the electrical heaters may be rotated to reach the initial positions if cooking is performed in the first cooking mode, while the electrical heaters may be rotated to reach respective operation positions if cooking is performed in the second cooking mode.

Further, the respective initial positions may be the respective positions where the electrical heaters are vertically positioned next to the left and right sidewalls of the cooking cavity, respectively, and the respective operation positions may be the positions where the electrical heaters are horizontally positioned between a top of the cooking cavity and a bottom of the cooking cavity.

Further, the heater position detection unit detects a position of one of the electrical heaters representing all of the electrical heaters if the two or more electrical heaters are operated in a common way.

The above and/or other aspects of the present invention are achieved by providing a microwave oven including a plurality of electrical heaters that are rotatably disposed in a cooking cavity, a heater drive unit that rotates the electrical heaters in a common cooking mode to be positioned at a common angle, and a heater position detection unit that detects respective vertical positions where the electrical heaters are vertically positioned, and horizontal positions where the electrical heaters are horizontally positioned, using a single detector.

Accordingly, the heater position detection unit may check respective positions of the electrical heaters in a case where the power is initially supplied or the power is re-supplied after the supply of the power is cut off.

Further, the respective initial positions may be the respective vertical positions.

Further, the electrical heaters may be disposed in the respective vertical positions if cooking is performed in the first cooking mode where food is cooked using the magnetron but not the electrical heaters, while the electrical heaters are disposed in the respective horizontal positions to cook the food if cooking is performed in the second cooking mode where the food is cooked using both the magnetron and the electrical heaters.

The above and/or other aspects of the present invention are achieved by providing a method of controlling a microwave oven, the microwave oven being provided with one or more detectors detecting respective rotation positions of electrical heaters, including checking operation states of the one or more detectors when power is supplied, rotating the electrical heaters until the respective rotation positions of the electrical heaters become respective initial positions, and performing cooking after adjusting the respective rotation positions of the electrical heaters to one of two or more respective rotation positions of the electrical heaters according to a desired cooking mode if the respective rotation positions of the electrical heaters become the respective initial positions.

Accordingly, a number of the detectors may be less than a number of the cooking modes.

Further, the one or more detectors may be micro switches.

Further, the method may include returning the electrical heaters to the respective initial positions after the cooking is terminated.

Further, the cooking modes may be divided into a first cooking mode where the food is cooked using the magnetron but not the electrical heaters, and a second cooking mode where the food is cooked using both the magnetron and the electrical heaters.

Further, the electrical heaters may be rotated to reach the initial positions if the cooking is performed in the first cooking mode, while the electrical heaters may be rotated to reach respective operation positions if the cooking is performed in the second cooking mode.

Further, the respective initial positions may be respective positions where the electrical heaters are vertically positioned next to left and right sidewalls of a cooking cavity respectively, and the respective operation positions may be respective positions where the electrical heaters are horizontally positioned between a top of the cooking cavity and a bottom of the cooking cavity.

BRIEF DESCRIPTION OF THE DRAWINGS

These and/or other aspects and advantages of the invention will become apparent and more readily appreciated from the following description of the preferred embodiment, taken in conjunction with the accompanying drawings of which:

FIG. 3 shows operation states of the middle heaters, a cam, and a micro switch of the microwave oven in accordance with the embodiment of the present invention;

DETAILED DESCRIPTION OF THE PREFERRED EMBODIMENT

Figure 1A:
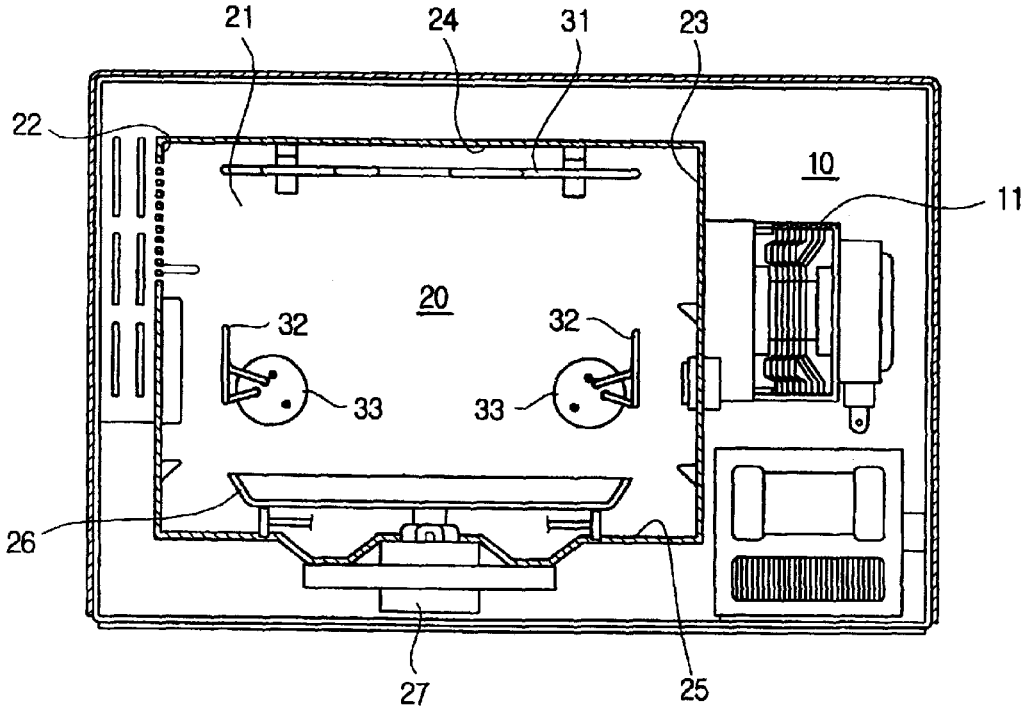
FIG. 1A is a front sectional view in which an upper heater and middle heaters are disposed in upper and middle portions, respectively, of a cooking cavity of a microwave oven in accordance with an embodiment of the present invention, where the middle heaters are vertically positioned.

Reference will now be made in detail to the present preferred embodiment of the present invention, examples of which are illustrated in the accompanying drawings, wherein like reference numerals refer to like elements throughout. The embodiment is described below in order to explain the present invention by referring to the figures.

Figure 1B:
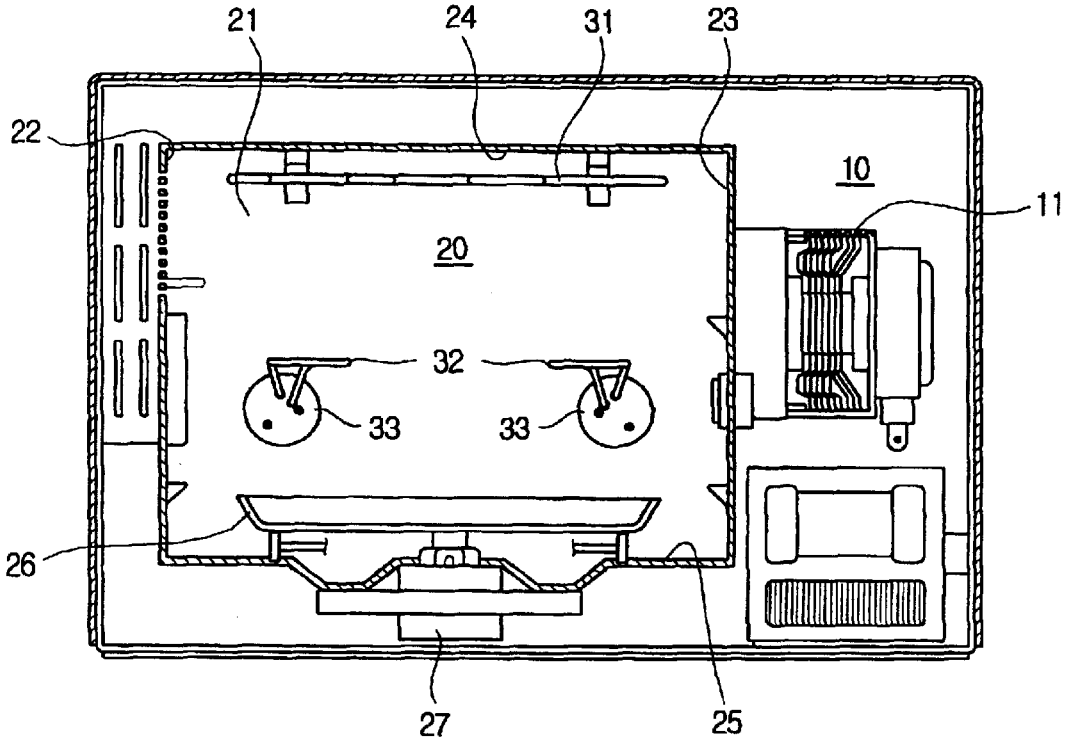
FIG. 1B is a front sectional view in which the upper heater and the middle heaters are disposed in the upper and middle portions, respectively, of the cooking cavity of the microwave oven in accordance with the embodiment of the present invention, where the middle heaters are horizontally positioned.

FIGS. 1A and 1B are respective front sectional views, in which an upper heater and middle heaters are disposed in upper and middle portions, respectively, of a cooking cavity of a microwave oven. FIG. 1A shows the middle heaters in a vertical position. FIG. 1B shows the middle heaters in a horizontal position.

As shown in FIGS. 1A and 1B, the microwave oven includes a machine room 10 in which microwaves are generated using electrical parts, such as a magnetron 11, and a cooking cavity 20 in which food is cooked using the microwaves generated from the magnetron 11.

The cooking cavity 20 has a back wall 21, a left sidewall 22 and a right sidewall 23, a top 24, a bottom 25, and a front opening. A door (not shown) is disposed at the front opening of the cooking cavity, and is used to selectively open and close the cooking cavity 20. A rotatable tray 26 and a tray motor 27 are disposed at the bottom 25 of the cooking cavity 20 such that the tray 26 on which the food is placed can be rotated.

Further, an upper heater 31 that radiates high temperature heat toward an upper portion of the cooking cavity 20 is disposed in a vicinity of the top 24 of the cooking cavity 20. A plurality of middle heaters 32 that radiate high temperature heat toward upper and lower portions of the cooking cavity 20 are disposed between the upper heater 31 and the rotatable tray 26. That is, the upper heater 31 is positioned in an upper portion of the cooking cavity 20, and the plurality of middle heaters 32 are positioned between the upper heater 31 and the rotatable tray 26. Accordingly, the food placed on a rack (not shown) disposed between the upper heater 31 and the middle heaters 32 receives heat at upper and lower surfaces of the food, and the food placed on the rotatable tray 26 receives heat at an upper surface of the food.

In a case where the middle heaters 32 are not needed to heat the food, the middle heaters 32 are vertically positioned next to the left and right sidewalls 22 and 23, respectively as shown in FIG. 1A. In a case where the middle heaters 32 are needed to heat the food, the middle heaters 32 are horizontally positioned to extend into a center of the cooking cavity 20 as shown in FIG. 1B. The middle heaters 32 are fixed to a pair of rotating members 33, respectively, rotatably disposed on the back wall 21 of the cooking cavity 20. The rotating members 33 are rotated by a heater drive unit disposed outside the cooking cavity 20 and described later, and a rotating operation of the rotating members 33 will be described with reference to FIGS. 2A and 2B.

Figure 2A:
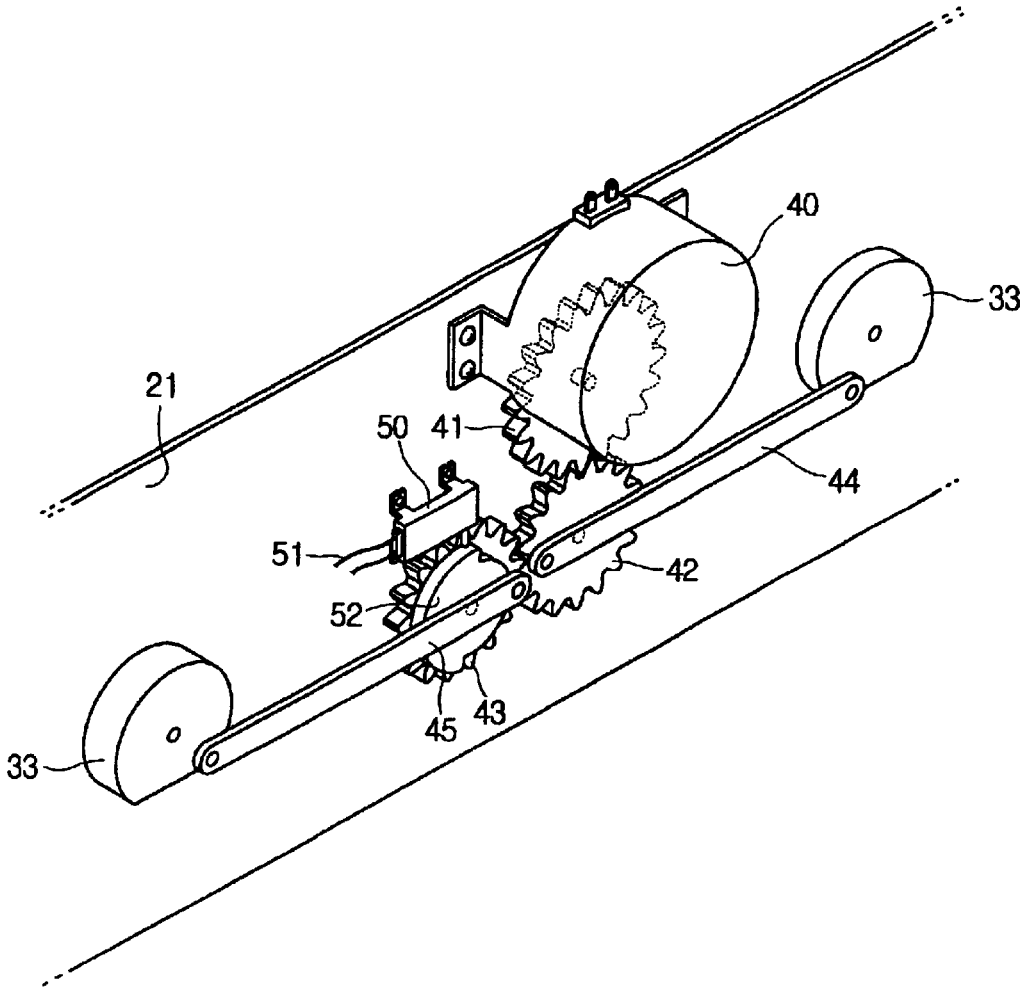
FIGS. 2A and 2B are perspective and sectional views, respectively, of a rotation drive unit rotating a plurality of middle heaters of the microwave oven in accordance with the embodiment of present invention.

As shown in FIG. 2A, the heater drive unit includes a heater motor 40 that rotates the middle heaters 32, a first gear 41 attached to a drive shaft of the heater motor 40 and rotated by the heater motor 40, second and third gears 42 and 43 connected in series to the first gear 41 to receive power of the heater motor 40, and first and second links 44 and 45 that, respectively, connect the second and third gears 42 and 43 with the rotating members 33.

Figure 2B:
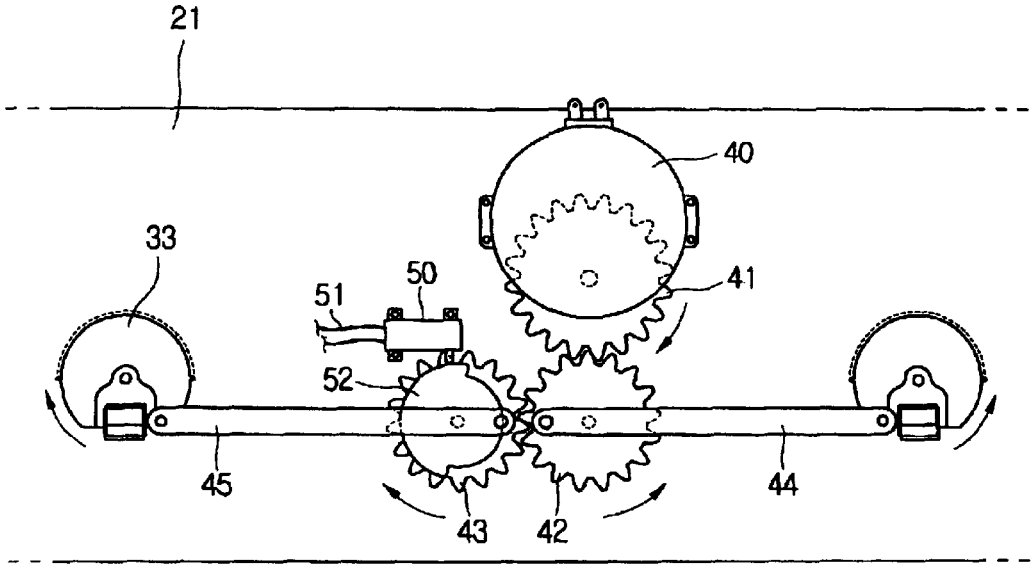

The first gear 41 is rotated by a driving force of the heater motor 40, and the second and third gears 42 and 43 engage with the first gear 41, and the third gear 43 engages with the second gear 42, respectively, and thereby are rotated. The rotating members 33 connected to the first and second links 44 and 45 are rotated in respective opposite directions, as shown in FIG. 2B. Respective rotation positions of the middle heaters 32 are changed by a common respective angle by the rotation of the rotating members 33.

A micro switch 50 that detects the respective rotation positions of the middle heaters 32 is positioned adjacent to the third gear 43. A cam 52 that operates the micro switch 50 is attached to the gear third 43. The micro switch 50 is connected to an electrical wire 51 that transfers a detection signal indicating the respective rotation positions of the middle heaters 32 to a control unit that will be described later. The cam 52 is shaped in a form of two semicircles having different radii and joined at straight edges thereof such that an arc of a semicircle with a large radius contacts with the micro switch 50 to turn-on the micro switch 50. An arc of a semicircle with a small radius may not contact with the micro switch 50 and therefore may not turn on the micro switch 50.

As shown in FIG. 3, when the heater motor 40 is driven in one direction to adjust the respective positions of the middle heaters 32, the micro switch 50 operated by the cam 52 is periodically turned on and off. With respect to the respective rotation positions of the heaters 32, the micro switch 50 is turned on for a period ranging from a time when the middle heaters 32 are positioned vertically and upwardly upright (0°) to a time just before the middle heaters 32 are positioned vertically and downwardly upright (180°). The micro switch 50 is turned off from a time when the middle heaters 32 are positioned vertically and downwardly upright (180°) to a time just before the middle heaters 32 are positioned vertically and upwardly upright (0°).

Accordingly, when the cam 50 is attached to the third gear 43 so that the micro switch 50 is turned on to correspond to the respective initial positions of the middle heaters 32, for example, the respective vertical positions, the respective rotation positions of the middle heaters 32 may be detected based a detection signal of the micro switch 50 operated by the cam 52.

If the respective initial positions of the middle heaters 32, that is, the respective vertical positions, are detected, the respective horizontal positions that the middle heaters 32 reach by being rotated by 90 degrees towards the center of the cooking cavity 20 from the respective vertical positions is automatically determinable by calculating a driving period of the motor 40. That is, since the micro switch 50 is turned on while the middle heaters 32 are moved from the respective vertical positions to the respective horizontal positions, the respective vertical positions of the middle heaters 32 are determined at the period when the driving time of the heater motor 40 is a same as a preset period by setting the preset time required for the middle heaters 32 to be moved from the respective vertical positions to the respective horizontal positions and counting the driving period of the heater motor 40.

Figure 4:
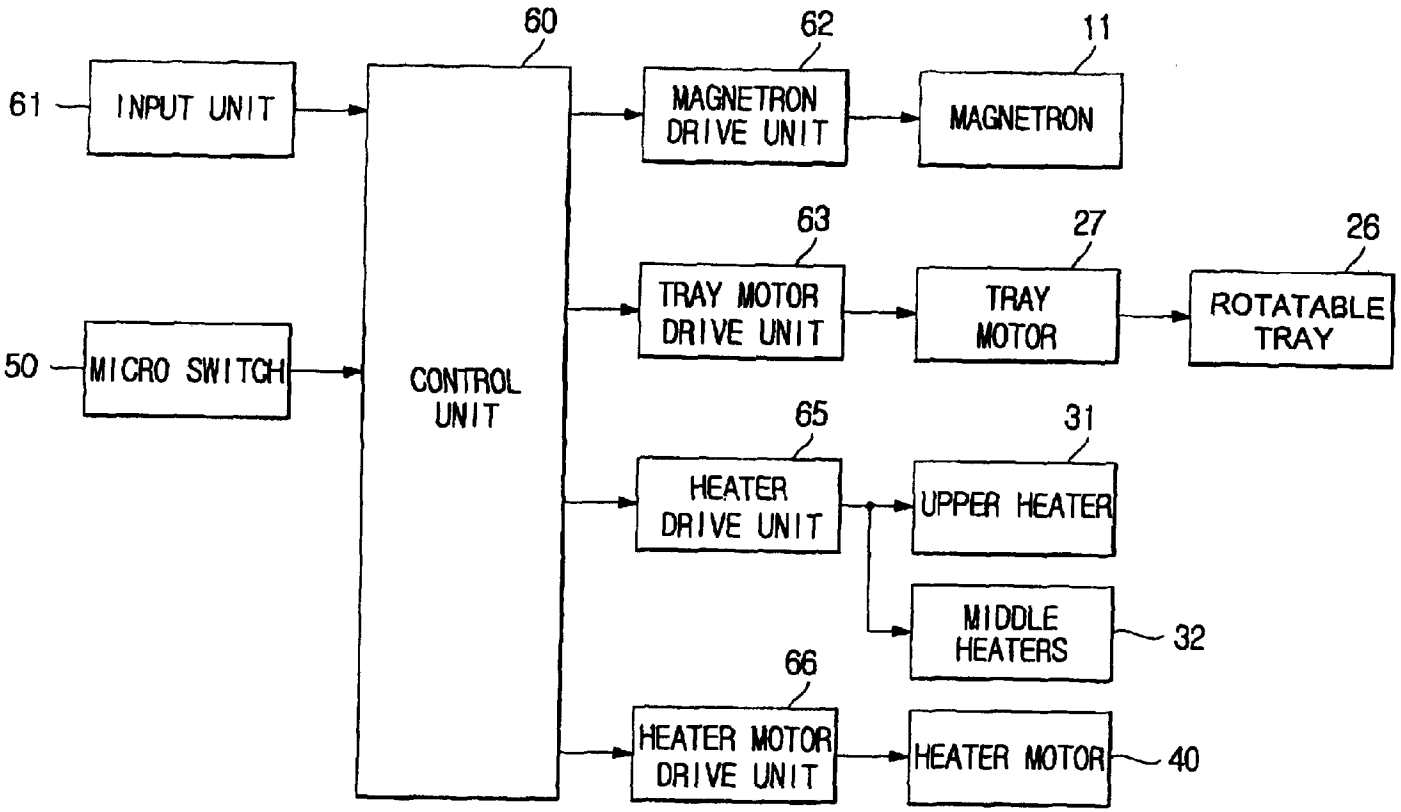
FIG. 4 is a control block diagram of the microwave oven in accordance with the embodiment of the present invention.
Figure 5:
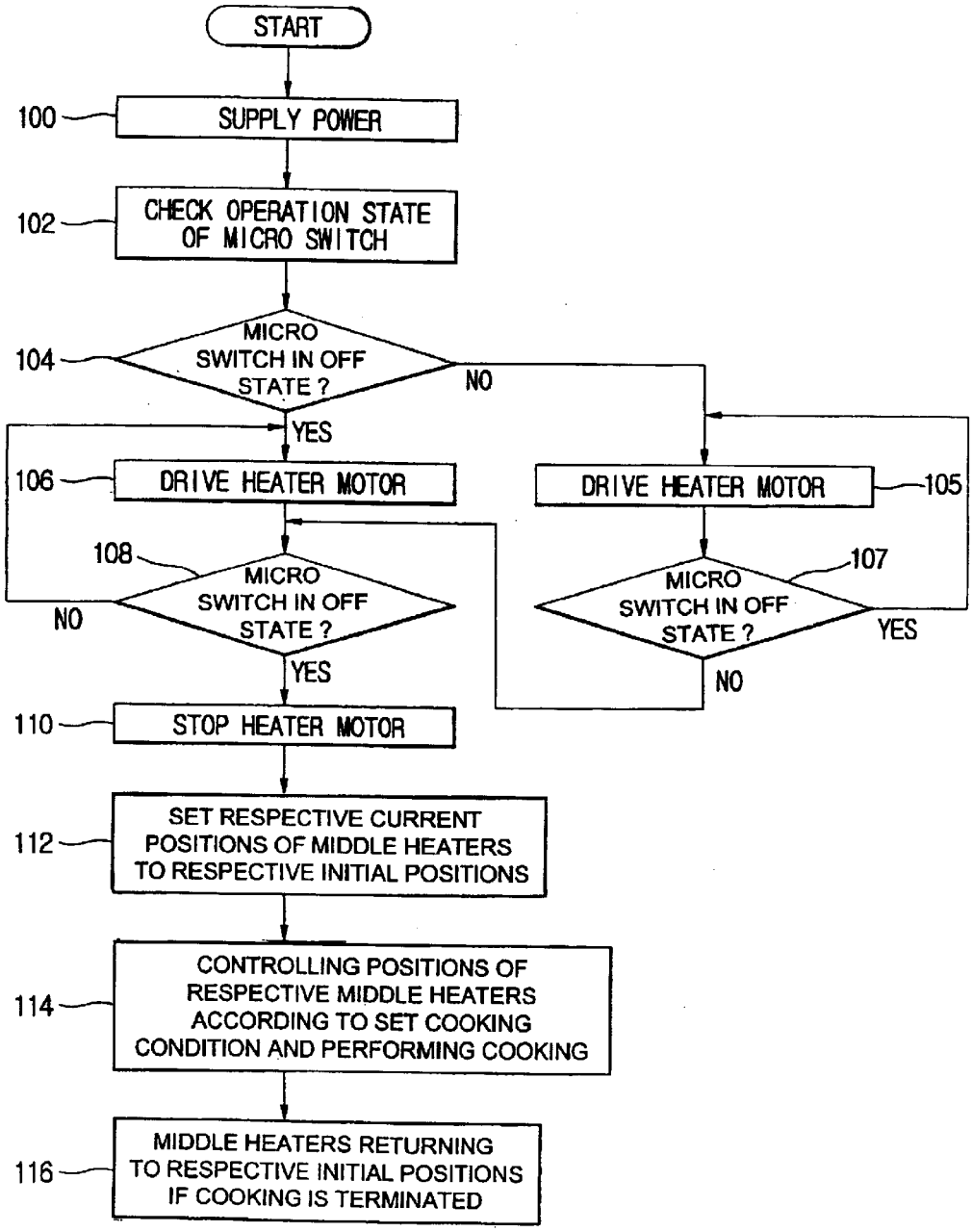
FIG. 5 is a flowchart of a method of controlling the microwave oven in accordance with the embodiment of the present invention.

FIG. 4 is a control block diagram of the microwave oven in accordance with the embodiment of the present invention. As shown in FIG. 4, input terminals of a control unit 60 that controls an overall operation of the microwave oven are connected to an input unit 61 that receives input commands from a user, as well as cooking conditions, and the micro switch 50 that detects the respective rotation positions of the middle heaters 32 rotatably disposed in the cooking cavity 20. Output terminals of the control unit 60 are connected to a magnetron drive unit 62 that drives a magnetron 11, a tray motor drive unit 63 that drives a tray motor 27 to rotate the rotatable tray 26, the heater drive unit 65 that drives the upper heater 31 and the middle heaters 32, and a heater motor drive unit 66 that drives the heater motor 40 to adjust the respective rotation positions of the middle heaters 32.

When power is initially supplied to perform cooking, the control unit 60 checks an on/off state of the micro switch 50. The control unit 60 determines whether the middle heaters 32 are positioned at the respective initial positions, for example, the respective vertical positions where the middle heaters 32 are not used and are vertically positioned next to the left and right sidewalls 22 and 23 of the cooking cavity 20, respectively, while controlling the heater motor 40 to rotate in one direction. If the middle heaters 32 reach the respective initial positions, the driving of the heater motor 40 is stopped. The control unit 60 determines the respective rotation positions of the middle heaters 32 according to the cooking conditions inputted to the input unit 61. If the middle heaters 32 are needed to heat the food according to the set cooking condition, the middle heaters 32 are moved from the respective initial positions thereof, that is, the respective vertical positions, to the respective horizontal positions thereof by driving the heater motor 40 for a preset period so that the middle heaters 32 reach the respective horizontal positions where they are horizontally positioned to extend into the center of the cooking cavity 20. If the middle heaters 32 are not needed to heat the food according to the set cooking condition, the heater motor 40 is not operated so that cooking is performed while the heaters 32 remain in the respective initial positions, that is, the respective vertical positions.

Further, when the power is re-supplied after the supply of the power is cut off during cooking, the control unit 60 controls the respective positions of the middle heaters 32 to correspond to the cooking modes by checking the respective initial positions of the middle heaters 32 as described above.

Hereinafter, a method of controlling the microwave oven is described with reference to the accompanying drawings. Hereinafter, operations to determine the respective initial positions of the plurality of middle heaters 32 using a single micro switch 50 will be mainly described. The respective initial positions are set to the respective vertical positions where the middle heaters 32 are not needed to heat the food and the micro switch 50 is turned on.

Power is supplied to the microwave oven to cook the food at operation 100. This operation is performed in the case where the power is initially supplied to start cooking, and the case where the power is re-supplied after the supply of the power is cut off by a power failure and so on.

If the power is supplied, the control unit 60 checks an operation state of the micro switch 50 at operation 102, and determines whether the operation state of the micro switch 50 is an OFF state at operation 104.

If the operation state of the micro switch 50 is the OFF state, the control unit 60 controls the heater motor drive unit 66 to drive the heater motor 40 at operation 106.

The middle heaters 32 are rotated by the driving of the heater motor 40, and the cam 52 attached to the third gear 43 is rotated along with the middle heaters 32. At this time, the control unit 60 determines whether the operation state of the micro switch 50 is an ON state at operation 108. If the operation state of the micro switch 50 is not the ON state as a result of the determination in operation 108, the heater motor 40 is continuously driven; if the operation state of the micro switch 50 is the ON state as the result of the determination in operation 108, the driving of the heater motor 40 is stopped at operation 110. Thereafter, the respective current positions of the middle heaters 32, that is, the respective vertical positions, are set to the respective initial positions at operation 112. Thereafter, if the middle heaters 32 are needed to heat the food according to the cooking condition inputted from the input unit 61, cooking is performed after the middle heaters 32 are moved from the respective initial positions, that is, the respective vertical positions, to the respective horizontal positions, by driving the heater motor 40 for the preset period at operation 114. If the middle heaters 32 are not needed to heat the food according to the cooking condition inputted from the input unit 61, the heater motor 40 is not operated, that is, cooking is performed in the respective initial positions using only the microwaves at operation 114. Thereafter, if a preset cooking period elapses and the cooking is terminated, the control unit 60 controls the middle heaters 32 to return to the respective initial positions at operation 116.

If the operation state of the micro switch 50 is the ON state as the result of checking of the operation state of the micro switch 50 at operation 102, that is, if the respective rotation positions of the middle heaters 32 are between the respective vertical positions and the respective horizontal positions, the control unit 60 controls the heater motor drive unit 66 to drive the heater motor 40 at operation 105. The middle heaters 32 are rotated by the driving of the heater motor 40, and the cam 52 attached to the third gear 43 is rotated along with the middle heaters 32. At this time, the control unit 60 determines whether the operation state of the micro switch 50 is the OFF state at operation 107. If the operation state of the micro switch 50 is not the OFF state, the heater motor 40 is continuously driven; while if the operation state of the micro switch 50 is the OFF state, the control unit 60 determines whether the operation state of the micro switch 50 is the ON state at operation 108. If the operation state of the micro switch 50 is the ON state, the driving of the heater motor 40 is stopped at operation 110. Thereafter, the respective current positions of the middle heaters 32, that is, the respective vertical positions, are set to the respective initial positions at operation 112. Thereafter, cooking is performed after the respective rotation positions of the middle heaters 32 are changed according to the cooking condition inputted from the input unit 61 at operation 114. Thereafter, if the predetermined cooking period elapses and the cooking is terminated, the control unit 60 controls the middle heaters 32 to return to the respective initial positions at operation 116.

As is apparent from the above description, the respective initial positions of the middle heaters are set using a single micro switch. Therefore, cooking is performed after the middle heaters are moved from the respective initial positions to the respective horizontal positions in the cooking mode in which cooking requiring the middle heaters to heat the food is performed, while cooking is performed with the middle heaters positioned in the respective initial positions in the cooking mode in which the cooking not requiring the middle heaters to heat the food is performed. Accordingly, a microwave oven and a method of controlling the same, in which the respective positions of the middle heaters are detected using detectors for which a number thereof is less than a number of the cooking modes, thereby reducing a manufacturing cost of the microwave oven by decreasing the number of the detectors to detect the respective positions of the middle heaters.

Additionally, the present invention provides a microwave oven and a method of controlling the same, in which an electrical wire is connected to a single micro switch to detect the respective positions of the middle heaters, thereby preventing inadequate cooking resulting from an incorrect connection of the micro switch and the electrical wire.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A microwave oven having a cooking cavity, comprising:

two or more electrical heaters rotatably disposed in the cooking cavity;

a heater drive unit that rotates the two or more electrical heaters; and a heater position detection unit that detects respective rotation positions of the two or more electrical heaters using one or more detectors, a number of the one or more detectors being less than a number of cooking modes of the microwave oven, wherein the plural heaters are rotated to respective initial positions when cooking food in a first cooking mode, and the plural heaters are rotated to respective operation positions, different from the respective initial positions, when cooking the food in a second cooking mode.

2. The microwave oven as set forth in claim 1, wherein each of the one or more detectors comprises:

a micro switch.

3. The microwave oven as set forth in claim 1, wherein the respective rotation positions of the two or more electrical heaters are changed according to the cooking modes.

4. The microwave oven as set forth in claim 1, wherein the heater position detection unit comprises:

a control unit that determines whether the respective rotation positions of the two or more electrical heaters are respective initial positions.

5. The microwave oven as set forth in claim 4, wherein the control unit checks the respective rotation positions of the two or more electrical heaters when power is initially supplied or when the power is re-supplied after a supply of the power is cut off.

6. The microwave oven as set forth in claim 4, wherein the respective initial positions comprise:

respective positions where the two or more electrical heaters are vertically positioned next to respective sidewalls of the cooking cavity.

7. The microwave oven as set forth in claim 4, wherein the heater position detection unit comprises:

a cam that operates the one or more detectors according to the respective rotation positions of the two or more electrical heaters.

8. The microwave oven as set forth in claim 1, wherein the heater drive unit comprises:

a motor having a drive shaft that rotates the two or more electrical heaters; and a gear that attaches to the drive shaft of the motor and rotates together with the drive shaft.

9. The microwave oven as set forth in claim 1, wherein the cooking modes comprise:

first and second cooking modes such that in the first cooking mode food is cooked using a magnetron but is not cooked using the two or more electrical heaters, and in the second cooking mode the food is cooked using both the magnetron and the two or more electrical heaters.

10. The microwave oven as set forth in claim 9, wherein the two or more electrical heaters are rotated to reach respective initial positions if cooking is performed in the first cooking mode, while the two or more electrical heaters are rotated to reach respective operation positions if cooking is performed in the second cooking mode.

11. The microwave oven as set forth in claim 10, wherein the respective initial positions are respective positions where the two or more electrical heaters are vertically positioned next to respective sidewalls of the cooking cavity, and the respective operation positions are respective positions where the two or more electrical heaters are horizontally positioned between a top of the cooking cavity and a bottom of the cooking cavity.

12. The microwave oven as set forth in claim 1, wherein if the two or more electrical heaters are operated in a common way, the heater position detection unit detects a position of one of the electrical heaters representing all of the electrical heaters.

13. A microwave oven having a cooking cavity, comprising:

two or more electrical heaters rotatably disposed in the cooking cavity;

a heater drive unit that rotates the two or more electrical heaters; and a heater position detection unit that detects respective rotation positions of the two or more electrical heaters using one or more detectors, a number of the one or more detectors being less than a number of cooking modes of the microwave oven, wherein the heater position detection unit comprises:

a control unit that determines whether the respective rotation positions of the two or more electrical heaters are respective initial positions, wherein the heater position detection unit comprises:

a cam that operates the one or more detectors according to the respective rotation positions of the two or more electrical heaters, wherein the cam comprises:

first and second semicircular regions having different radii and joined at straight edges thereof such that an arc of the first semicircular region with a first radius contacts with a selected one or ones of the detectors to turn on the selected one or ones of the detectors, while an arc of the second semicircular region with a second radius does not contact with the one or more detectors and does not turn on the one or more detectors.

14. The microwave oven as set forth in claim 13, wherein the cam is positioned in a vicinity of one detector and contacts only the one detector.

15. The microwave oven as set forth in claim 13, wherein the first radius of the first semicircular regions of the cam is larger than the second radius of the second semicircular region of the cam.

16. A microwave oven having a cooking cavity, comprising:

a plurality of electrical heaters that are rotatably disposed in the cooking cavity;

a heater drive unit that rotates the plurality of the electrical heaters in a common cooking mode at a common angle; and a heater position detection unit having a single detector that detects respective vertical positions where the plurality of the electrical heaters, respectively, are vertically positioned, and respective horizontal positions where the plurality of the electrical heaters, respectively are horizontally positioned.

17. The microwave oven as set forth in claim 16, wherein the heater position detection unit checks respective positions of the plurality of the electrical heaters when power is initially supplied or when the power is re-supplied after a supply of the power is cut off.

18. The microwave oven as set forth in claim 16, wherein respective initial positions of the plurality of heaters are the respective vertical positions.

19. The microwave oven as set forth in claim 16, wherein the plurality of the electrical heaters are disposed in the respective vertical positions to cook food when cooking is performed in a first cooking mode such that the food is cooked using a magnetron but the food is not cooked using the plurality of the electrical heaters, and the plurality of the electrical heaters are disposed in the respective horizontal positions to cook the food when cooking is performed in a second cooking mode such that the food is cooked using both the magnetron and the plurality of the electrical heaters.

20. A microwave oven having a cooking cavity, comprising:

plural heaters moveably disposed in the cooking cavity;

a heater drive unit to move the plural heaters; and a heater detection unit having one or more detectors to detect respective positions of the plural heaters using the one or more detectors, a number of the detectors being less than a number of cooking modes of the microwave oven, wherein the plural heaters are rotated to respective initial positions when cooking food in a first cooking mode, and the plural heaters are rotated to respective operation positions, different from the respective initial positions, when cooking the food in a second cooking mode.

21. The microwave oven as set forth in claim 20, wherein each of the detectors comprises:

a micro switch.

22. The microwave oven as set forth in claim 20, wherein the respective positions of the plural electrical heaters are changed according to the cooking modes.

23. The microwave oven as set forth in claim 20, wherein the heater detection unit comprises:

a control unit to determine if the respective positions of the plural heaters are respective initial positions.

24. The microwave oven as set forth in claim 23, wherein the control unit checks the respective positions of the plural heaters when power is initially supplied or when the power is re-supplied after a supply of the power is cut off.

25. The microwave oven as set forth in claim 23, wherein the respective initial positions comprise:

respective positions where the plural heaters are vertically positioned next to respective sidewalls of the cooking cavity.

26. The microwave oven as set forth in claim 23, wherein the heater detection unit comprises:

one or more cams to operate one or more corresponding detectors, each one of the detectors operating according to positions of a corresponding one or ones of the plural heaters.

27. The microwave oven as set forth in claim 20, wherein the heater drive unit comprises:

a motor to rotate the plural heaters; and one or more gears operatively connected between the plural heaters and the motor such that a rotation of the motor moves the plural heaters.

28. The microwave oven as set forth in claim 20, wherein the respective initial positions are respective positions where the plural heaters are positioned adjacent to respective sidewalls of the cooking cavity, and the respective operation positions are other respective positions where the plural heaters are positioned remote from the respective sidewalls of the cooking cavity.

29. A microwave oven having a cooking cavity, comprising:

plural heaters moveably disposed in the cooking cavity;

a heater drive unit to move the plural heaters; and a heater detection unit having one or more detectors to detect respective positions of the plural heaters using the one or more detectors, a number of the detectors being less than a number of cooking modes of the microwave oven, wherein the heater detection unit detects the respective positions of the plural heaters by counting the driving period of the heater drive unit and comparing the counted driving period with preset values corresponding to the respective positions of the plural heaters.

30. A microwave oven having a cooking cavity, comprising:

plural heaters moveably disposed in the cooking cavity;

a heater drive unit to move the plural heaters; and a heater detection unit having one or more detectors to detect respective positions of the plural heaters using the one or more detectors, a number of the detectors being less than a number of cooking modes of the microwave oven, wherein the respective positions of the plural heaters are all positioned parallel to each other and extend in a first direction in a first cooking mode and are all aligned with each other and extend in a second direction, different from the first direction, in a second cooking mode.

31. The microwave oven as set forth in claim 30 further comprising:

a magnetron, wherein;

the first cooking mode comprises:

cooking food using only the magnetron to irradiate the food with microwaves; and the second cooking mode comprises:

cooking the food using both the magnetron to irradiate the food with the microwaves and the plural heaters to heat the food.

32. The microwave oven as set forth in claim 30, wherein the first direction is a vertical direction and the second direction is a horizontal direction.

33. A microwave oven having a cooking cavity, comprising:

plural heaters moveably disposed in the cooking cavity;

a heater drive unit to move the plural heaters; and a heater detection unit having one or more detectors to detect respective positions of the plural heaters using the one or more detectors, a number of the detectors being less than a number of cooking modes of the microwave oven, wherein when the plural heaters are moved, the heater detection unit detects a position of one of the plural heaters representing the respective positions of all of the heaters.

* * * * *